United States Patent [19]

Foller

[11] Patent Number: 4,477,322

[45] Date of Patent: Oct. 16, 1984

[54] PROCESS FOR PRODUCING HYDROGEN CHLORIDE

[75] Inventor: Peter C. Foller, Berkeley, Calif.

[73] Assignee: Chevron Research Company, San Francisco, Calif.

[21] Appl. No.: 499,135

[22] Filed: May 31, 1983

[51] Int. Cl.[3] ..... C25B 1/22

[52] U.S. Cl. ..... 204/103; 204/294

[58] Field of Search ..... 204/103, 98, 94

[56] References Cited

U.S. PATENT DOCUMENTS 3,124,520 3/1964 Juda ..... 204/103

3,963,592 6/1976 Lindstrom ..... 204/103

4,069,117 1/1978 Cooper ..... 204/103

FOREIGN PATENT DOCUMENTS 644087 2/1963 Belgium ..... 204/103

43797 4/1977 Japan ..... 204/103

*Primary Examiner*—T. Tung

*Attorney, Agent, or Firm*—D. A. Newell; J. M. Whitney; J. J. DeYoung

[57] ABSTRACT

Disclosed is a gaseous diffusion anode and a process for the production of gaseous hydrogen chloride in an electrolytic cell.

3 Claims, 1 Drawing Figure

PROCESS FOR PRODUCING HYDROGEN CHLORIDE

FIELD OF THE INVENTION

Figure 1:
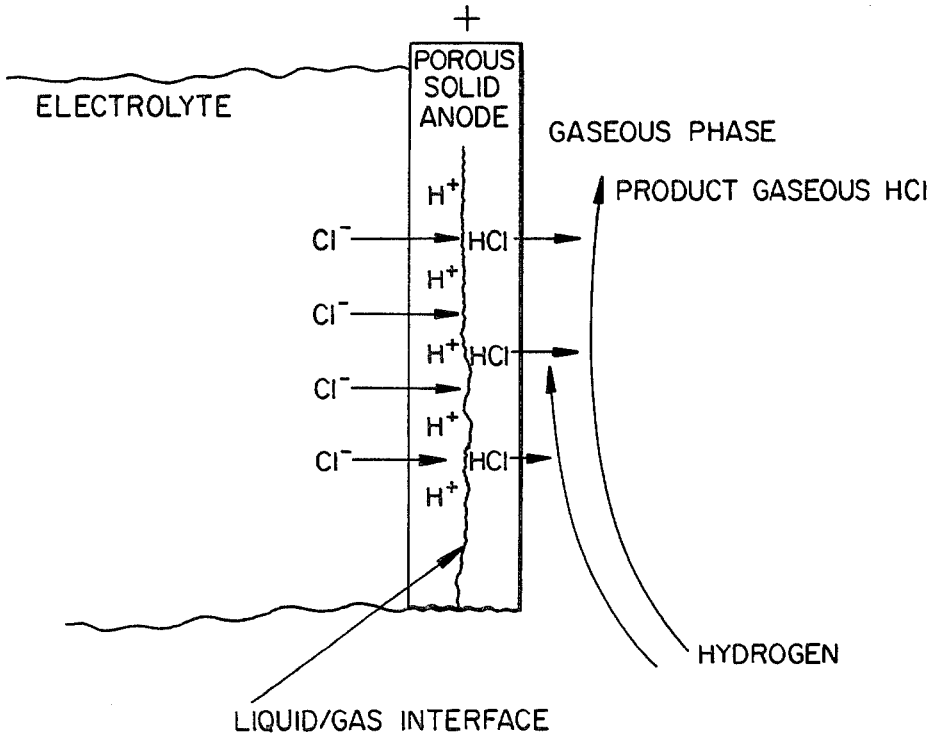

The present invention relates to electrochemical apparatus and processes for the production of hydrogen chloride. More particularly, the present invention relates to the production of gaseous hydrogen chloride at the anode of an electrolytic cell.

BACKGROUND OF THE INVENTION

Electrolytic processes for the production of sodium hydroxide, hydrogen, and chlorine from brine are well known in the art.

U.S. Pat. No. 3,963,592, the entire disclosure of which is incorporated herein by reference, discloses an electrolytic process for the producton of sodium hydroxide and chlorine from brine. Alternatively, the process produces sodium hydroxide and aqueous hydrogen chloride from brine and hydrogen. The process utilizes a gas anode which is capable of operating both as a hydrogen diffusion anode or a chlorine-producing anode. When operated as a hydrogen anode, the hydrogen is passed through a first layer and then a second layer of the anode and hydrogen ions formed react with chloride ions to produce hydrochloric acid in the anolyte. Accumulation of the hydrogen chloride, in the liquid anolyte, is undesirable when one desires a relatively pure and dry hydrogen chloride gas. It also reduces the current efficiency of the electrochemical cell if hydroxyl ions are to be generated at the cathode.

SUMMARY OF THE INVENTION

An improved process for the production of hydrogen chloride in an electrolytic cell containing a chloride ion-containing liquid electrolyte and a hydrogen-consuming, hydrogen ion-producing gas anode, the improvement comprising utilizing an anode which is selectively permeable to the movement of chloride ions from said electrolyte into said anode and substantially impermeable to the movement of hydrogen chloride into said electrolyte, whereby chloride ions react with hydrogen ions in said anode and gaseous hydrogen chloride is liberated from the gaseous side of said anode.

DETAILED DESCRIFTION OF THE INVENTION

One object of the present invention is to produce gaseous hydrogen chloride in an electrolytic cell using a hydrogen-consuming, hydrogen ion-producing gas anode.

Another object of the present invention is to provide an electrolytic cell anode which is permeable to the movement of chloride ions from a chloride ion-containing electrolyte and substantially impermeable to the movement of hydrogen chloride into the electrolyte.

Electrolytic cells are well known in the art. They consist of an anode, a cathode and a liquid electrolyte. Frequently, such cells are contained in a single vessel and the electrolytic solutions comprise an anolyte and catholyte which are separated by a barrier which is permeable to the flow of selected ions.

Gas diffusion fuel-cell type anodes are also well known in the art and may generally be described as having a gaseous side and a liquid (electrolyte) side.

Referring now to FIG. 1. A chloride ion-containing liquid electrolyte is on the liquid side of the porous solid anode and a hydrogen-containing gas is on the gaseous side of the anode. The electrolyte and the hydrogen penetrate the anode and form a liquid-gas interface. A portion of the hydrogen is converted to hydrogen ions and reacts with the chloride ions from the electrolyte forming hydrogen chloride. The hydrogen chloride formed is liberated from the gaseous side of the anode and may be swept away along with unreacted hydrogen.

The anode is constructed to allow a three-phase interface for oxidation of hydrogen and having anion exchanger properties to enhance generation of gaseous hydrogen chloride. The anode is constructed so that it is selectively permeable to the movement of chloride ions from the electrolyte into the anode and substantially impermeable to the movement of hydrogen chloride into the electrolyte. The anode can consist of several layers with each layer having different properties. For example, the diffusion anode may comprise a first layer consisting of a membrane (or film) which is selectively permeable to the movement of chloride ions through the layer and selectively impermeable to the movement of hydrogen chloride. This first layer, which is in contact with the electrolyte, can be bonded to a second layer, which is electrically conductive and which is permeable to the movement of hydrogen ions and hydrogen chloride. The first layer is made selectively impermeable to the movement of hydrogen chloride by chemical modification. One preferred modification being by amine functionalization. This is accomplished by the presence of amine groups in the first layer. By "amine functionalization", it is meant that amino groups ($—NH_2$) are chemically attached to the solid component making up the anode. Preferably, the amine is attached to particulate carbon. The amine groups, when they are positively charged ($—NH_3{}^{+}Cl^{-}$), inhibit the diffusion of hydrogen ions into the bulk of the electrolyte and thus, the hydrogen ions react with the chloride ions passing into the first layer forming hydrogen chloride which escapes through the second layer via the gaseous side of the anode. The first layer may comprise a composite or membrane of amine-functionalized carbon which is bonded into a composite by a solid polymeric material such as polytetrafluoroethylene. The carbon is preferably a high-surface-area carbon having from 25 to 300 meters$^2$/gram surface area and more preferably 50 to 250 meters$^2$/gram.

The second electrically conductive layer may be a porous metal, preferably a porous metal composite such as a noble metal dispersed on carbon. The noble metal is present to catalyze the formation of hydrogen ions. Preferred noble metals are platinum and palladium.

Preferably, the entire anode is one electrically conductive composite and not layers of different materials having different properties. Perferably, the anode is a composite of high-surface area, amine-functionalized carbon catalyzed with a highly-dispersed noble metal, all of which is bonded together with a polymer forming a porous, semihydrophobic structure. The active material can also be placed into or within a solid polymer (Teflon) impregnated carbon paper or carbon cloth structure. Alternatively, it may be rolled into a fine-metallic mesh to improve current collection and distribution.

The anode is functionalized to inhibit hydrogen chloride from entering the electrolyte by positively charged groups affixed to the anode. One way carbon can be readily amine-functionalized is by first attaching carboxylic acid groups (—COOH) to the carbon composite and then reacting these carboxylic acid groups with a hydroxy-containing amine to form aminoesters or with a diamine to form amino amides. Suitable hydroxy amine and diamines include: ethanolamine, 3-hydroxypropyl amine, ethylenediamine, diethylenetriamine, and the like. The amine groups then protonate in use in the presence of hydrogen chloride is positively charged ammonium salts ($—NH_3^+Cl^-$).

The production of gaseous hydrogen chloride at the anode, in accordance with the present invention, is preferably combined with the production of sodium hydroxide as catholyte as is more fully described in my copending application, Ser. No. 499,134, entitled "Electrolytic Process For Production of Gaseous Hydrogen Chloride and Aqueous Alkali Metal Hydroxide", filed on the same date as the present invention, the entire disclosure of which is incorporated herein by reference.

The present invention is further illustrated by the following example.

EXAMPLE

A 1-inch square piece of carbon paper fuel-cell electrode, purchased from Prototech Company, was floated on 20 mls of 0.25 Molar sodium dichromate in 5% $H_2SO_4$. Vacuum was applied to fill the hydrophobic structure. Oxidation was enhanced by heating to 95° C.–97° C. for 45 minutes with rapid stirring. The procedure was then repeated. Next, the electrode was washed with 3 rinses of 5% $H_2SO_4$, 2 rinses of distilled water, and 1 rinse of methanol, each of which were performed with vacuum filling. A portion of the carbon was reacted yielding acid (—COOH) functional sites which was confirmed through IR spectra of a dried and ground piece of the electrode. The absorbance of the 1730 $cm^{-1}$ carbonyl band was evident, as well as an increase in OH absorbance at 3600–3200 $cm^{-1}$.

The electrode was then further reacted with ethylene diamine (15 mls in 60 mls of ethylene glycol) and refluxed at 100° C. for 8 hours. The material was then washed with 2 rinses of water and 1 of methanol. Infrared analysis confirmed the amine functionality on the carbon substrate of the electrode. The 1670 $cm^{-1}$ N-H stretch appeared, and the 1730 $cm^{-1}$ carbonyl band had shifted slightly with the presence of adjacent functionality.

The functionalized electrode, as prepared above, is mounted in the apparatus described in my copending application Ser. No. 499,134, entitled "Electrolytic Process For Production of Gaseous Hydrogen Chloride and Aqueous Metal Hydroxide", filed on the same date as the present application. An electrical potential is applied across the electrodes, hydrogen gas is passed over the anode, and gaseous hydrogen chloride is recovered from the gaseous side of the gas diffusion anode along with unreacted hydrogen.

What is claimed is:

1. An improved process for the production of hydrogen chloride in an electrolytic cell containing a chloride-containing liquid electrolyte and a hydrogen-consuming, hydrogen ion-producing gas anode, said gas anode having a gaseous side which is in contact with said hydrogen and a liquid side which is in contact with said electrolyte, the improvement comprising utilizing an anode which is selectively permeable to the movement of chloride ions from said electrolyte into said anode and substantially impermeable to the movement of hydrogen chloride into said electrolyte, whereby chloride ions react with hydrogen ions in said anode and gaseous hydrogen chloride is liberated from the gaseous side of said anode, said anode being made selectively permeable by the incorporation of amino ($—NH_2$) groups in said anode.

2. The process of claim 1 wherein said electrolyte comprises aqueous sodium chloride.

3. The process of claim 2 wherein gaseous hydrogen chloride is liberated from the gaseous side of said anode along with unreacted hydrogen.

* * * * *